United States Patent [19]

Hanson

[11] Patent Number: 4,475,326

[45] Date of Patent: Oct. 9, 1984

[54] INTERLOCKING BUILDING BLOCKS AND SYSTEM USING THE SAME

[76] Inventor: Gary N. Hanson, P.O. Box 172, Snoqualmie, Wash. 98065

[21] Appl. No.: 349,593

[22] Filed: Feb. 17, 1982

[51] Int. Cl.[3] ..... E04C 1/10

[52] U.S. Cl. ..... 52/286; 52/591

[58] Field of Search ..... 52/282, 284, 286, 590, 52/591, 592, 436, 439, 593, 594, 578, 782, 815, 503, 309.4, 595, 589, 588, 561, 572, 569

[56] References Cited

U.S. PATENT DOCUMENTS

| | | | |
|---|---|---|---|
| 460,177 | 9/1891 | Cook | 52/591 |
| 1,418,168 | 5/1922 | Preston | 52/591 |
| 2,209,564 | 7/1940 | Grubb | 52/589 X |
| 2,209,730 | 7/1940 | Hausner | 52/589 |
| 2,619,829 | 12/1952 | Tatum | 52/591 |
| 3,895,148 | 7/1975 | Chang | 52/592 X |
| 4,041,670 | 8/1977 | Kaplan | 52/591 |

FOREIGN PATENT DOCUMENTS

| | | | |
|---|---|---|---|
| 427575 | 4/1969 | Australia . | |
| 48006 | 11/1933 | Denmark . | |
| EP01360 | 4/1979 | European Pat. Off. | 52/591 |
| 97369 | 7/1898 | Fed. Rep. of Germany | 52/589 |
| 2817857 | 8/1979 | Fed. Rep. of Germany . | |
| 57907 | 5/1953 | France | 52/591 |
| 1211247 | 10/1959 | France . | |
| 2396135 | 1/1979 | France . | |
| WO81/01721 | 6/1981 | PCT Int'l Appl. . | |
| 377083 | 6/1964 | Switzerland . | |
| 235873 | 4/1926 | United Kingdom . | |
| 703926 | 2/1954 | United Kingdom | 52/286 |

*Primary Examiner*—J. Karl Bell

[57] ABSTRACT

A family of interlocking polyurethane foam building blocks configured similarly to conventional concrete building blocks. Tongues and grooves are formed on the end faces of a universal block in such a manner that the end faces of two identical blocks will engage with one another when the blocks are longitudinally aligned and the end faces are in abutment. The tongues and grooves are configured so that the building blocks may be rotated about any axis of the block and still interlock with an identical block. The upper and lower surfaces of the universal block are formed with projections and recesses configured to engage with the projections and recesses on an abutting surface of an identical block that is longitudinally offset by one-half the length of the block. The projections and recesses are configured and arranged to allow the universal block to be rotated about any axis of the block and still interlock with an identical block. A corner block, half block, three-quarter block, pilaster block, and bond beam block constitute the rest of the family of building blocks. These blocks are configured to interlock with the universal block and allow construction of a walled structure using conventional concrete block building techniques.

26 Claims, 15 Drawing Figures

INTERLOCKING BUILDING BLOCKS AND SYSTEM USING THE SAME

BACKGROUND OF THE INVENTION

The present invention relates to interlocking building blocks and a system for using the same, and more particularly to a set of lightweight interlocking building blocks and a system for using the same in which conventional concrete block construction techniques can be employed.

Conventional concrete or "cinder" blocks have been employed for many years in the construction of residential and commercial buildings. Generally, concrete blocks comprise a rectangular polyhedron carrying a pair of vertically oriented apertures. Concrete blocks are built-up into a wall by laying a plurality of successive courses or rows of concrete blocks. The concrete blocks in one row are offset by one-half the length of the block with respect to concrete blocks in the next adjacent course. The vertically oriented apertures in the concrete blocks, however, remain aligned so that successive apertures join to form an aperture that reaches from the bottom to the top of a wall. Once the wall is constructed, reinforcing steel is generally inserted into these apertures at selected locations, the apertures are then filled with concrete, which, when set, forms a reinforced column. Similarly, a modified concrete block is employed in selected courses to form a horizontal reinforcing beam. The modified concrete block is referred to as a bond beam block and has a longitudinally extending U-shaped channel that runs the full length of the upper portion of each of the bond beam blocks. Once a course of bond beam blocks is laid, the longitudinally extending channels of the bond beam blocks are lined along the entire course with coarse paper or other material to form a trough that extends longitudinally along the entire course of bond beam blocks. Reinforced steel is then laid in the trough and the trough is filled with concrete to form a reinforcing horizontal beam referred to as a bond beam along the entire length of a wall. These bond beams combined with the columns provide a reinforcing network for walls constructed from concrete blocks.

Concrete blocks are generally molded at a manufacturing site from cement and aggregate. The concrete blocks, which are relatively heavy, are then transported to the construction site where they are used. Not only are the concrete blocks heavy and thus expensive to transport, the aggregate in a cement matrix is a relatively poor insulator. Thus, it is normally necessary in concrete block construction to utilize interior insulation if the interior temperature of a building built from concrete blocks is to be maintained at a level different than that of ambient conditions surrounding the building. Additionally, concrete block courses are generally joined to each other with mortar. Thus, skilled and expensive labor is required to construct or erect a concrete block building.

Many attempts have been made to provide a substitute for conventional concrete blocks that are easy to utilize, require little skilled labor to erect, are lightweight, and are inherently good insulators. As a consequence, a variety of interlocking building blocks have been suggested by the art, including those composed of polymeric foam materials. None, however, has met with any commercial success.

SUMMARY OF THE INVENTION

The present invention fulfills the needs not met by the prior art by providing a substitute for conventional concrete blocks. The present invention comprises a lightweight, interlocking building block composed preferably of a polymeric foam material. In its broadest aspect, the interlocking building block comprises a pair of spaced sidewalls, and first and second end walls spaced from each other and adjoined to the sidewalls. The end walls have respective first and second end faces, each of which include at least one longitudinally projecting tongue and one longitudinally recessed groove. The tongue and groove on the second end face are positioned at substantially identical locations as the tongue and groove on the first end face, so that the tongue and groove on one face are complementary to and engage with a respective tongue and groove on an abutting face of an identical block that is longitudinally aligned with the builing block. As a consequence, first and second building blocks can be longitudinally aligned so that their respective tongues and grooves engage when the end faces are abutted. Because of the unique location of the tongues and grooves however, one block can be rotated 180° about a longitudinal or vertical axis with respect to the other and still present complementary and engaging tongues and grooves.

Similarly, the upper and lower surfaces of each of the building blocks constructed in accordance with the present invention carries a pair of vertically extending projections and adjoining vertically oriented recesses. The projections and recesses are shaped and positioned so that one of the pair of projections and recesses is complementary to and engages with a respective projection and recess on an abutting surface of an identical block that is longitudinally offset by one-half the length of the block. As a consequence, the building blocks of the present invention can be stacked in successive courses in an offset manner in accordance with conventional concrete block construction techniques. Additionally, however, the blocks interlock by the vertically extending projections and recesses. Moreover, the projections and recesses are arranged such that the block can be rotated 180° about a longitudinal or vertical axis while still presenting and engaging abutting faces.

The foregoing block is referred to herein as a universal block. Complementary interlocking blocks constructed in accordance with the present invention that correspond to the concrete blocks of the prior art with the same name are also provided. Such blocks include a half block, a three-quarter block, a corner block, a pilaster block, and a bond beam block.

A BRIEF DESCRIPTION OF THE DRAWINGS

A better understanding of the present invention can be derived by reading the ensuing specification in conjunction with the accompanying drawings wherein.

DETAILED DESCRIPTION

Figure 1:
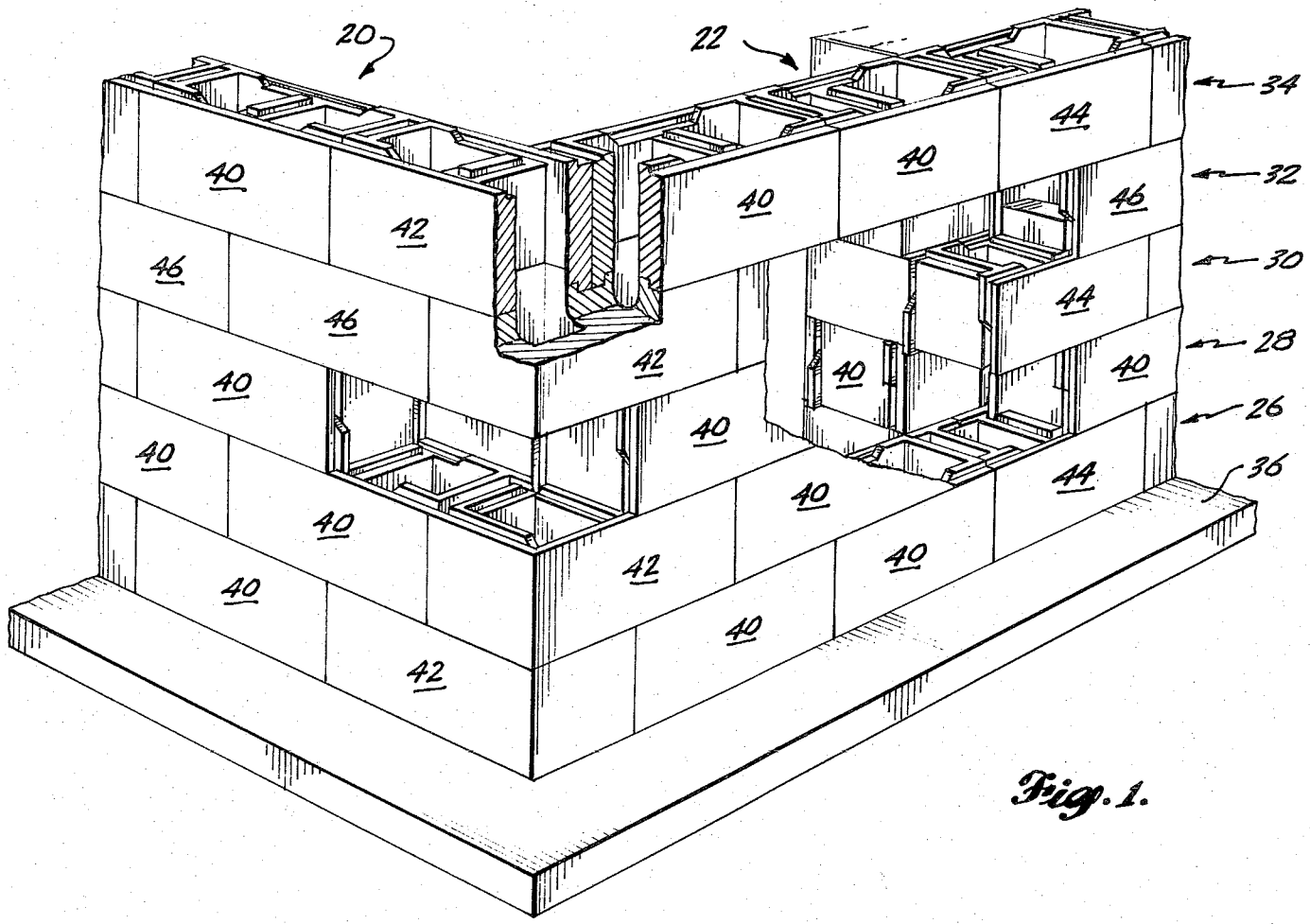
FIG. 1 is an isometric view of a pair of intersecting walls constructed with the interlocking building blocks of the present invention.

Referring first to FIG. 1, a pair of intersecting walls 20 and 22 are constructed from building blocks made in accordance with the present invention. The basic building block, referred to herein as the universal block and described in more detail below, has a plurality of projections and recesses on its upper and lower surfaces, and tongues and grooves on its end faces. The projections, recesses, tongues and grooves are constructed so that the universal block can be materially interlocked with another universal block along abutting end faces as well as interlocked on abutting upper and lower surfaces when the blocks are offset by one-half their length in the longitudinal direction. Thus, the blocks are employed in an offset manner in successive courses similar to concrete blocks in conventional concrete block construction.

As depicted, intersecting walls 20 and 22 are shown only partially complete and comprise five successive courses 26, 28, 30, 32 and 34 laid upon a foundation 36. First course 26 comprises a row of longitudinally aligned universal blocks 40 with a corner block 42. The corner block is a variation on the universal block that is configured to allow a corner to be formed in a wall by rotating every other corner block 90° about a vertical axis and 180° about a longitudinal, horizontal axis. Also, for purposes of illustration, a pilaster block 44 is included in the bottom course 26 of wall 22. In essence, a pilaster block configured in accordance with the present invention is incorporated into a wall in the same manner as a pilaster block is incorporated into a wall made with conventional concrete block construction. The second course 28 comprises a plurality of universal blocks 40 connected with a corner block 42 at the corner. Note that the corner block in the second course 28 has been rotated 90° about a vertical axis and 180° about a longitudinal, horizontal axis from the corner block in the first course 26. Additionally it is to be noted that a second block 40 is positioned on the exposed half of the pilaster block 44 of the first course 26. The third course 30 comprises a pilaster block 44 and a plurality of universal blocks 40. A corner block 42 is omitted so that the interconnecting projections and recesses of the corner block 42 of the course 28 can be seen. The fourth course 32 comprises a plurality of bond beam block 46 in walls 20 and 22 interconnected with a corner block 42. A last course 34 shown in FIG. 1 comprises: a pilaster block 44; a plurality of universal blocks 40; and, a corner block 42.

Figure 2:
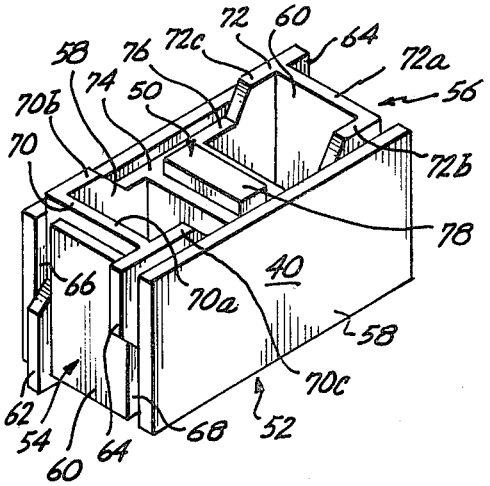
FIG. 2 is an isometric view of a universal block constructed in accordance with the preferred embodiment of the present invention.
Figure 3:
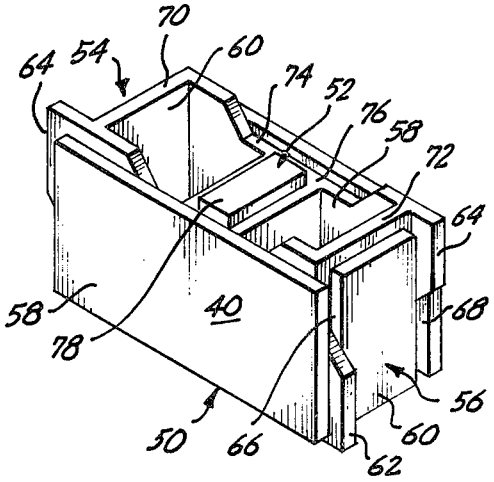
FIG. 3 is an isometric view of the block of FIG. 2 rotated 180° about a longitudinal, horizontal axis and 90° clockwise about a vertical axis.

Referring now to FIGS. 2 and 3, the universal block 40 has identical upper and lower surfaces 50 and 52 and identical end faces 54 and 56. That is, the universal block has no top or bottom and has no right or left sides. The block has sidewalls 58 and end walls 60. Each of the end walls 60 carries first and second tongues 62 and 64. The tongues are basically rectangular in cross section and generally vertically oriented. One of the tongues 62 is placed adjacent one of the upper and lower surfaces 50 and 52 and the other of the tongues 64 is positioned adjacent the other of the upper and lower surfaces. The tongues 62 and 64 are equidistantly spaced on opposite sides of a vertical centerline across the end face 54. A pair of grooves 66 and 68 extend into each of the end faces. The grooves 66 and 68 are vertically aligned with the tongues 62 and 64 and are of course equidistantly spaced from a vertical centerline across the end face. The ends of the tongues 62 and 64 adjacent grooves 66 and 68 are formed at a 45° angle with respect to the end face of block 40. The 45° surface faces outwardly and extends inwardly from the outer edge of the tongue into the adjacent groove. As stated previously, the end faces 54 and 56 are identical, thus requiring the tongues 62 and 64 and grooves 66 and 68 to be identically positioned on opposite end faces. As a consequence, when the end face of one universal block is abutted with the identical or an opposite face on an identical universal block, the tongues of one block will engage the grooves of the adjacent abutting block and vice versa. Thus, the universal blocks when longitudinally aligned in a row or course are interlocked with the next adjacent block in a horizontal direction.

Similarly, the upper and lower surfaces 50 and 52 of the block 40 are identical and each carry a pair of projections 70 and 72 and a corresponding pair of recesses 74 and 76. One of the projections 70 is positioned adjacent one end of the upper or lower surface of a block and the other projection 72 is positioned adjacent the opposite end face. The projections are generally configured like an "h" when viewed in a vertical direction, and are identical to each other. Projection 70 comprises a web 70*a* that extends laterally across the surface of the block 40 and a flange 70*b* that is oriented longitudinally relative to the surface. One end of the flange 70*b* is integral with and connected to the web 70*a* while the other end extends away from the web toward the opposite end face. A second flange 70*c* has its central portion connected with the opposite end of web 70*a*. Flange 70*c* is parallel to 70*b* and thus extends longitudinally across the surface 50 or 52 of the block. One end of the flange 70*c* extends from the web toward the opposite end face while the other end of the flange 70*c* not only projects vertically from the surface of the block but also preferably projects longitudinally from the block. Furthermore, it is preferred that the flange 70*c* and the tongue 64 be positioned the same lateral distance from a vertical centerline across a face of a block so that they abut each other and can be made integral at the intersection of a face and a surface.

As previously stated the vertically extending projection 72 is identical to the vertically extending projection 70. Thus, it is necessary for the long flange 72*c* to be positioned adjacent a diagonal quarter of the upper surface 50 of the block 40 from the long flange 70*c*. Recesses 74 and 76 are located adjacent projections 70 and 72 and are recessed extend vertically into the upper surface of the block. The recess 76 for example is configured to receive the projection 72 of a first identical block that is positioned so that its surface is abutting the surface of the given block, but offset from the given block by one-half the length of the block. Similarly, the other recess 74 is configured to receive the projection on an abutting surface of a second identical block that is longitudinally aligned with the first identical block and has its end faces abutting and engaging with the end face of the first identical block. As a consequence, the recesses 74 and 76 are configured like an "H" having a cross member that has a width greater than the vertical members of the "H." A small rectangular locator 78 is formed in the central portion of the cross member, with the vertically oriented lateral sides of this locator 78 forming a stop in the longitudinal direction for the web of an "h"-shaped projection when engaging with a recess in that surface. Thus, the locator 78 serves as an aid for one universal block 40 being interlocked with a second universal block 40 so that the blocks are offset exactly one-half their length when they are engaged or interlocked. The upper surface of the locator 78 is positioned at the same level as the upper edges of the sidewalls and the end walls. The recesses are positioned below that level and the upper edges of the projections 70 and 72 are spaced above the upper surface of the locator and the wall edges.

The ends of flanges 70*b*, 70*c*, 72*b*, and 72*c* of projections 70 and 72 adjacent recesses 74 and 76 form surfaces that are oriented at 45° with respect to the upper surface of the projections. The 45° surfaces face outwardly and extend from the outer surfaces of the flanges into the adjacent recesses. The function of the 45° surfaces of projections 70 and 72 is to coact with the previously mentioned 45° surfaces of tongues 62 and 64 to facilitate the engagement of one universal block 40 with another as the blocks are laid in the courses of a wall.

Figure 4:
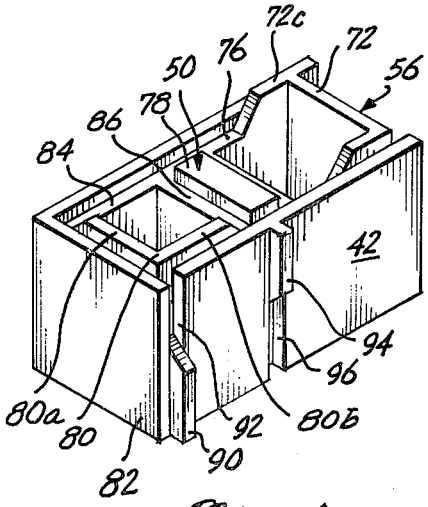
FIG. 4 is an isometric view of a corner block constructed in accordance with the present invention.
Figure 5:
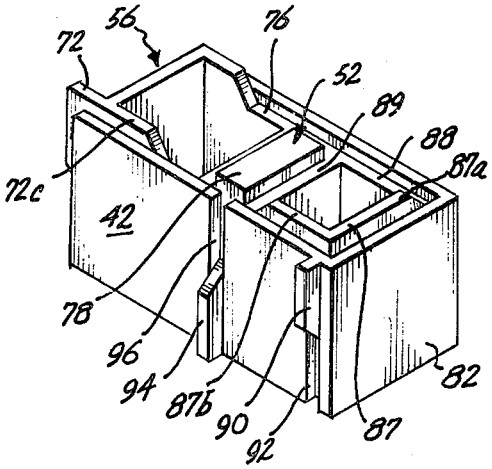
FIG. 5 is an isometric view of the corner block of FIG. 4 rotated 90° counterclockwise about a vertical axis and 180° about a longitudinal, horizontal axis.

Referring now to FIGS. 4 and 5, one-half of the corner block 42 on a first side of a vertically and laterally extending center plane is identical to that of the universal block 40. Thus, it carries projections such as projections 72 and recesses 76. The end face opposite the end that is identical to the universal block, however, is smooth as it will be exposed on the outer surface of the wall when used. The upper surface 50 of the corner block 42 on the second side of the center plane carries a vertically extending L-shaped projection 80. The L-shaped projection 80 carries one flange 80*a* positioned adjacent the smooth face 82 and a second flange 80*b* joined to and extending orthogonally from the flange 80*a*. The flange 80*b* is positioned at the diagonally opposite end of the upper surface 50 from the long flange 72*c* of the "h"-shaped projection 72. Thus, the flange 80*b* extends longitudinally along the upper surface while the flange 80*a* extends laterally across the upper surface. The flanges 80*a* and 80*b* are of equal length. A pair of recesses 84 and 86 are oriented orthogonally to each other and oriented orthogonally respectively from flanges 80*a* and 80*b* of projection 80. Recess 84 is spaced from and equal in length to flange 80*b*. Similarly, recess 86 is spaced from and equal in length to flange 80*a*. The projection 80 and recess 84 and 86 are thus sized and shaped so that when an identical surface carrying the projection 80 and recesses 84 and 86 is rotated 90° about a vertical axis and 180° about a longitudinal, horizontal axis and abutted against an identical surface, the projections on one surface mate with the recesses on the other surface.

The lower surface 52 of the corner block 42 on the second side of the vertically and laterally extending center plane also carries an L-shaped projection 87. Like the L-shaped projection on the upper surface, one flange 87*a* of the projection is positioned adjacent the smooth face 82. However, the second flange 87*b* that extends orthogonally from flange 87*a* is located on the lower surface 52 in a position longitudinally aligned with long flange 72*c*. Here again, flange 87*b* extends longitudinally along the lower surface 52 while flange 87*a* extends laterally across the lower surface. The flanges 87*a* and 87*b* are also of equal length. As on the upper surface 50, a pair of recesses 88 and 89 are oriented orthogonally to each other and oriented orthogonally respectively from flanges 87*a* and 87*b* of projection 87. Recesses 88 and 89 are spaced from and equal in length to flanges 87*b* and 87*a*, respectively. Like the projection and recesses on the upper surface 50, projection 87 and recesses 88 and 89 are sized and shaped so that when an identical surface carrying projection 87 and recesses 88 and 89 is rotated 90° about a vertical axis and 180° about a longitudinal, horizontal axis and abutted against an identical surface, the projections on one surface mate with the recesses on the other surface. Thus, the corner block 42 is universal to the extent that it can be used either for a righthand or a lefthand corner as required in alternating courses. See, for example, the corner blocks 42 of FIG. 1.

Like the universal block 40, the upper and lower surfaces of the corner block 42 have three different levels, the bottom surface of the recesses 84, 86, 88, 89, and 76 are the first level, the upper edges of the side and end walls are the second level along with the upper surface of the locator member 78, and the upper edges of the projections 80, 87, and 72 are the third outermost level. In addition to the variation just described with respect to the projections 80 and 87 and recesses 84, 86, 88, and 89, the corner block also carries two pairs of tongues and grooves 90 and 92, and 94 and 96. The tongues and grooves 90 and 92, and 94 and 96, are identical in construction to the tongues and grooves 62, 64, 66, and 68 on the end faces of the universal blocks. The tongues and grooves 90, 92, 94, and 96 are situated on the half of one sidewall adjacent the location of flange 80*b* and 87*b*. Thus, the end face of a universal block 40 can be abutted against and interlocked with the half of a sidewall of a corner block 42 carrying the tongue and groove pairs 90, 92, 94, and 96.

Figure 6:
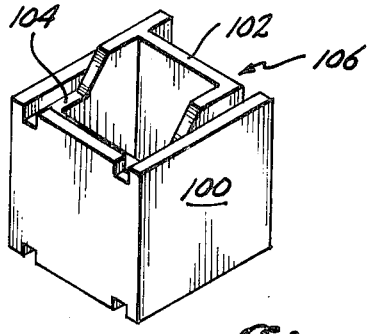
FIG. 6 is an isometric view of a half block constructed in accordance with the present invention.
Figure 7:
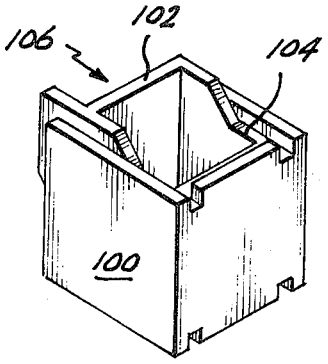
FIG. 7 is an isometric view of the half block of FIG. 6 rotated 90° counterclockwise about a vertical axis and 180° about a longitudinal, horizontal axis.
Figure 8:
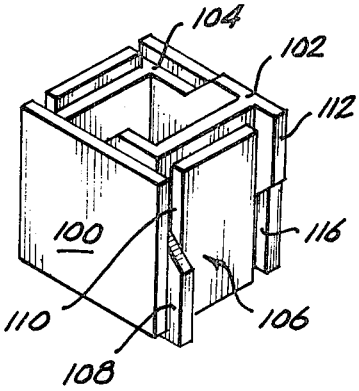
FIG. 8 is an isometric view of the block of FIG. 7 rotated180° about a vertical axis.

The half block 100 illustrated in FIGS. 6, 7 and 8 is employed in terminating a wall with a straight vertical edge at a location other than a corner. The half block 100 is essentially a universal block 40 which has been cut in half along a laterally and vertically extending center plane. The half block 100 carries projections 102 and complementary recesses 104 that correspond for example to the projections 72 and recesses 76 along the surfaces 50 and 52 of a universal block 40. Additionally the end face 106 of the half block carries two pairs of tongues and grooves 108 and 110, and 112 and 116. These tongue and groove pairs correspond to and can engage with the tongue and groove pairs 62, 64, 66, and 68 on a universal block.

Figure 9:
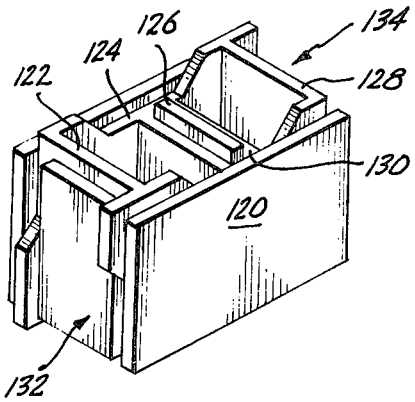
FIG. 9 is an isometric view of a three-quarter length block constructed in accordance with the present invention.
Figure 10:
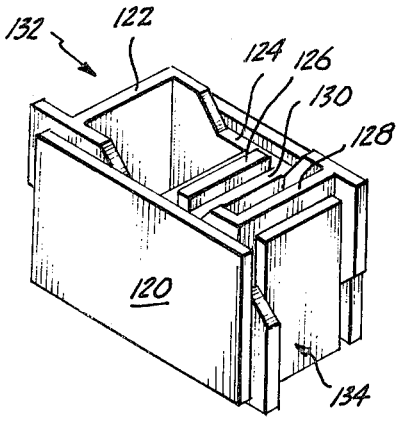
FIG. 10 is an isometric view of the three-quarter length block of FIG. 9 rotated 90° clockwise about a vertical axis and 180° about a longitudinal, horizontal axis.

The next variation on the universal block 40 is the three-quarter length block 120 illustrated in FIGS. 9 and 10. The three-quarter length block 120 has one end that corresponds exactly to one-half of the universal block 40 or a half block 100. This end carries projections 122, recesses 124, and locators 126 on the upper and lower surfaces 50 and 52, and tongue and groove pairs on the end face. The other end of the block, however, is reduced in its longitudinal dimension by approximately one-half the length of a half block 100. This foreshortening is accomplished by decreasing the length of the sidewalls and decreasing the longitudinal dimension of the flanges and recesses over what they are on a universal block. Thus, the foreshortened end of the three-quarter block carries an "h"-shaped projection 128 and an "h"-shaped recess 130. However, longitudinal extending flanges on the "h"-shaped projection 128 are shortened along with the corresponding logitudinally extending portions of the recess 130. Both the upper surface 50 and lower surface 52 of the three-quarter block 120 are identical because the flanges and ratio of the surfaces are of different lengths, however, the block is not universal. That is, only a foreshortened section upper or lower surface will interlock with a foreshortened section upper or lower surface of another three-quarter length block 120, while the portion of the block that is similar to a half block 100 will of course interlock with either half blocks 100 or universal blocks 40. The purpose of the three-quarter length block is to provide the capability, when building a wall, of reducing the wall length by one-quarter the length of a universal block by substituting a three-quarter length block in each successive course in the appropriate location. Of course, as with the universal block 40, the end faces 132 and 134 of the three-quarter block 120 are identical to those on the universal block 40. Thus, end faces of the three-quarter length blocks universally engage with the end faces of the universal block 40, half-block 100, or corner block 42.

Figure 11:
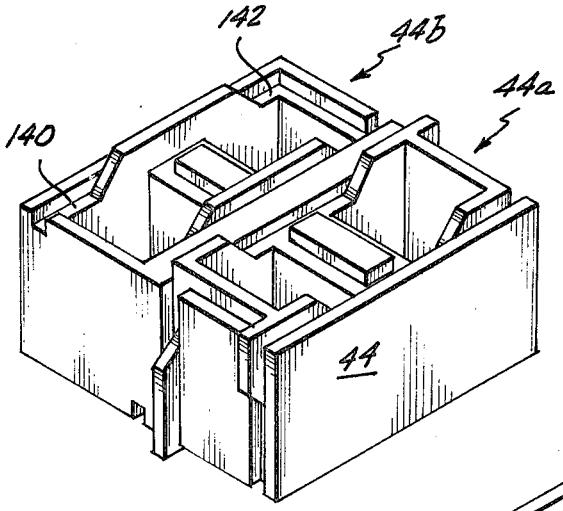
FIG. 11 is an isometric view of a pilaster block constructed in accordance with the present invention.
Figure 12:
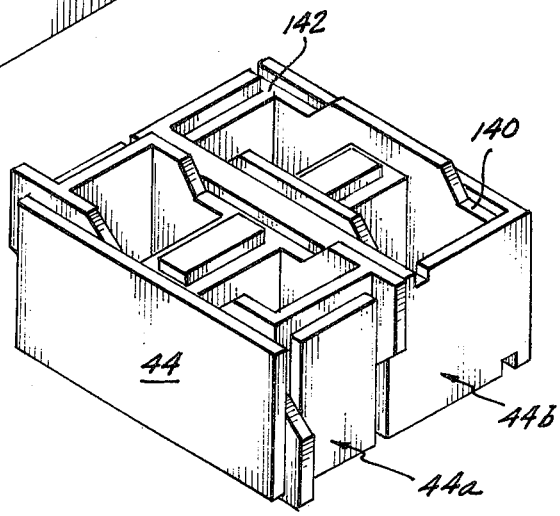
FIG. 12 is an isometric view of the pilaster block of FIG. 11 rotated 90° clockwise about a vertical axis and 180° about a lateral, horizontal axis.

The pilaster block 44 illustrated in FIGS. 11 and 12 is square in configuration when viewed from above or below and is twice the width of a universal block 40. A first half of the pilaster block 44, designated 44*a*, is virtually identical in construction to a universal block and will interlock both of its end faces and upper and lower surfaces with universal blocks in the manner identical to a universal block. The second half of the pilaster block, designated 44*b*, has recesses 140 and 142 adjacent opposite ends of each of its upper and lower surfaces that are shaped and designed to receive the "h"-shaped projections on a universal block that are abutted against the surface of the second half 44*b* of the pilaster block. In the following manner, the pilaster block 44 is utilized in alternate courses beginning with the bottom course when constructing a wall. The universal block portion 44*a* of the block 44 is substituted for the location that would otherwise be occupied by a universal block 40. In alternate courses where a pilaster block 44 is not employed, however, a universal block 40 is engaged with the second half 44*b* of the pilaster block. The pilaster block residing in the next course has its universal block portion 44*a* engaging the previous course of offset universal blocks 40, while the bottom portion of the second half 44*b* of the next pilaster block engages the upper surface of a universal block 40 sitting on the second half of the next lower pilaster block. In this manner an entire pilaster column can be constructed utilizing pilaster blocks of the present invention along with universal blocks.

Figure 13:
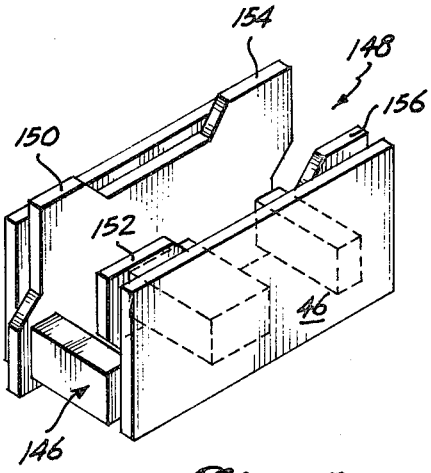
FIG. 13 is an isometric view of a bond beam block constructed in accordance with the present invention.
Figure 14:
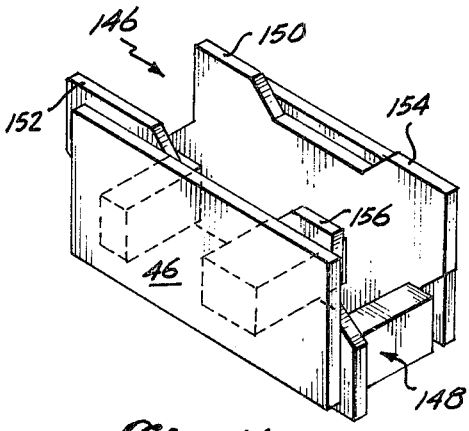
FIG. 14 is an isometric view of the bond beam block of FIG. 13 rotated 90° clockwise about a vertical axis.

The last block necessary to erect a wall utilizing the universal block 40 of the present invention, but still employing conventional concrete block construction techniques, is the bond beam block 46 illustrated in FIGS. 13 and 14. The bond beam block 46 is similar in construction on its end faces 146 and 148 and its lower surface to a universal block 40. However, the central lateral portion adjacent the upper surface, as well as the upper surface between the vertically extending flanges of the "h"-shaped projections are removed from the universal block in order to create the bond beam block 46. Thus, only the vertically extending projections 150, 152, 154, and 156 corresponding to the flanges 70*b*, 70*c*, 72*b*, and 72*c* of the universal block remain in addition to the upper portions of the sidewalls, as well as the upper portion of the central portion of the block between the longitudinally extending flanges. The lower portion of the end walls and the lower central portion of the bond beam block remain in order to support a bottom surface that is identical to that of a universal block 40. In practice, an entire course of bond beam blocks is erected. Heavy paper is then formed in the shape of a "U" in the longitudinally open portion of the bond beam block 46 to form a continuous trough in the bond beam course. This trough can then be utilized as a form for holding reinforcing steel as well as concrete to form a bond beam similar to that employed in conventional concrete block construction.

Figure 15:
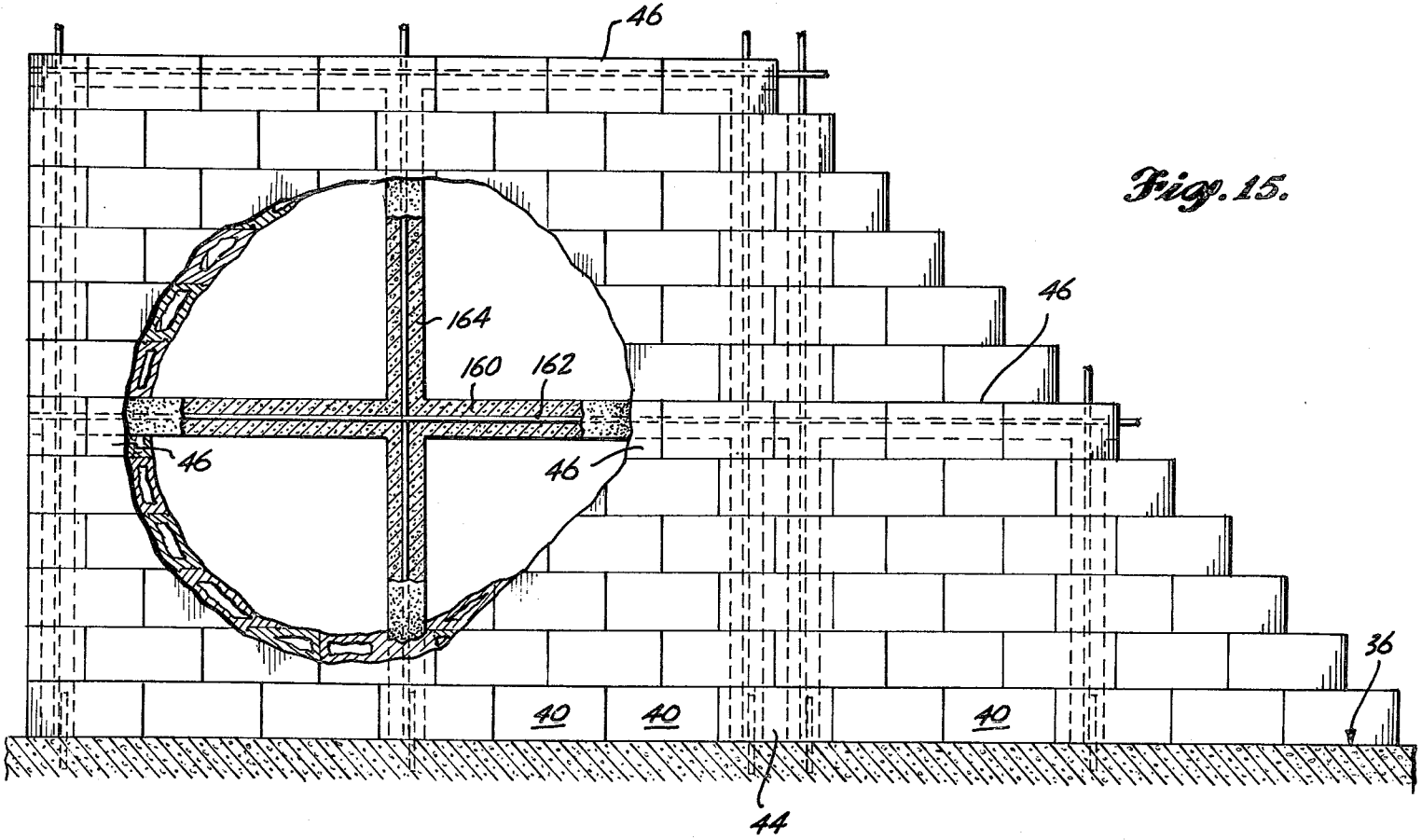
FIG. 15 is an elevation view of a wall constructed of the building blocks of the present invention in which conventional concrete block construction techniques of employing concrete columns and bond beams are illustrated.

FIG. 15 illustrates a wall constructed in accordance with the present invention. A first course of universal blocks 40 is laid on a foundation 36. In practice, when the foundation is made of concrete, the first course of universal blocks is laid before the concrete of the foundation has set up, thus allowing the universal blocks 40 to sit flat on the foundation and not sit up on projections 70 and 72. Universal blocks 40 are positioned at longitudinally spaced locations along the wall with five courses of universal blocks being laid. The sixth course of the wall is comprised of bond beam blocks 46. After the bond beam course has been laid, a bond beam 160 including reinforcing steel 162 is constructed as described above in conjunction with the bond beam blocks 46. The remaining courses of universal blocks 40 are then erected. The top course can also be comprised of bond beam blocks 46 as illustrated. Once the wall is completed, vertical columns 164 are poured in place through the vertically aligned holes in successive courses of blocks. Construction of the bond beams 160 and the vertical columns 164 is performed in accordance with standard concrete wall construction procedures.

The interlocking building blocks of the present invention are preferably constructed of a lightweight material. One convenient manner of making the blocks is by filling a mold cavity of the appropriate shape with an appropriate polymeric material and a foaming agent, and thereafter allowing the polymeric material to foam and thus expand into the shape of the mold. The most preferred material is polyurethane. A commercially available polyurethane foam system includes a twopound density foam sold by the Steppin Chemical Company of Northfield, Ill.

As a consequence of the configuration of the building blocks and the use of polyurethane foam in their manufacture, lightweight, interlocking building blocks of the present invention can be employed to build strong, insulated wall structures employing conventional concrete block construction techniques. The advantages of handling the lightweight building blocks as well as their insulating characteristics can be enjoyed without any significant drawbacks.

The present invention has been described in relation to a preferred embodiment and variations upon that embodiment. One of ordinary skill after reading the foregoing specification will be able to effect various changes, alterations, and substitutions of equivalents without departing from the broad concepts disclosed. It is therefore intended that the scope of Letters Patent granted hereon be limited only by the definitions contained in the appended claims and equivalents thereof.

The embodiments of the present invention in which an exclusive property or priviledge is claimed are defined as follows:

1. An interlocking building block comprising:

a pair of spaced sidewalls, and first and second end walls joining said sidewalls and being spaced from each other, said end walls having respective first and second end faces, each end face of said block carrying a first longitudinally aligned tongue and groove pair and a second longitudinally aligned tongue and groove pair, said first and second pairs being laterally spaced on said end face at locations equidistant from the center of the end face, said first pair having a tongue positioned adjacent a groove, said second pair having a tongue positioned adjacent a groove, said tongue and groove pairs on said second end face being positioned at substantially identical locations as said tongue and groove pairs on said first end face, said tongue and groove pairs further being positioned so that each tongue and groove pair on each of said faces is complementary to and engages a respective groove and tongue pair on an abutting end face of an identical block that is longitudinally aligned with said building block.

2. The block of claim 1 wherein each of said tongues is identically sized and each of said grooves is equally sized to receive complementary tongues.

3. The block of claim 2 wherein said tongues are extensions of said sidewalls.

4. The block of claim 1 wherein said tongues and grooves are offset from the longitudinal centerline of the block.

5. The block of claim 1 wherein a portion of each said tongue adjacent each said groove is constructed with a surface oriented at 45° to said end face of said block, said surface facing outwardly and extending from an outer surface of said tongue into said adjacent groove.

6. An interlocking building block comprising:

a pair of spaced sidewalls, and first and second end walls joining said sidewalls and being spaced from each other, said block having upper and lower surfaces, each of said surface carrying a pair of vertically extending projections and adjoining vertical recesses, said projections being "h" shaped and having a web joining a first flange to a second shorter flange, said web extending laterally across said surfaces and said flanges extending longitudinally along said surfaces, said projections and recesses being shaped and positioned so that one of said pair of projections and recesses is complementary to and engages a respective pair of projections and recesses on an abutting surface of an identical block that is longitudinally offset by one-half the length of said block.

7. The block of claim 6 wherein a first half of each of said upper and lower surfaces of said block lying on one side of a lateral centerline is substantially identical to the second half of said surfaces lying on the other side of said lateral centerline.

8. The block of claim 7 wherein one of said pair of projections and recesses on each surface is positioned on said first half and the other of said pair of projections and recesses is positioned on said second half of said surface.

9. The block of claim 6 wherein said projections on each surface are spaced and the paired recesses are positioned between said projections, said recessed being "H" shaped, each of said recesses having a web portion joining a first flange portion to a second flange portion, said flange portions extending longitudinally along said surface, said web portion extending laterally across said surface.

10. The block of claim 9 wherein an end portion of said first and said second flanges closest to said recesses is configured with a surface oriented at 45° with respect to an upper edge of said flanges, said 45° surface facing outwardly extending from the uppermost surface of said flanges into said recesses.

11. The block of claim 10 wherein said web is joined to the central portion of said first flange and the end portion of said second flange, and wherein said web portion is joined to the central portion of said first flange portion and to the end of said second flange portion.

12. The block of claim 11 further comprising a rectangular projection located in the center of each of the lower and upper surfaces of said block, said projections lying between the web portions of adjoining recesses.

13. The block of claim 12 wherein said upper and lower surfaces comprise three sets of horizontal surfaces each located at a different level, the bottom surface of said recesses being at a first level, the horizontal surfaces of said sidewalls and the horizontal surface of said rectangular projection lying at a second level, and the horizontal surfaces of said projections lying at a third outermost level.

14. The block of claim 6 wherein the upper and lower surfaces of said block are substantially identical.

15. The block of claim 6 wherein each of said end faces has at least one longitudinally projecting tongue and one longitudinally extending groove, said tongue and groove being positioned at substantially identical locations on said first and second end faces and further being positioned so that the tongue and groove on each of said faces is complementary to and engages a respective groove and tongue on an abutting end face of an identical block that is longitudinally aligned with said building block.

16. The block of claim 15 wherein each end face of said block carries first and second tongue and groove pairs, said first and second pairs being laterally spaced on said end face at locations equidistant from the center of the end face, said first pair having a tongue positioned below a groove, said second pair having a tongue positioned above a groove.

17. The block of claim 16 wherein a portion of each said tongue adjacent each said groove is constructed with a surface oriented at 45° to said end face of said block, said surface facing outwardly and extending from an outer surface of said tongue into said adjacent groove.

18. The block of claim 16 wherein each of said tongues is identically sized and each of said grooves is equally sized to receive complementary tongues.

19. The block of claim 18 wherein said tongues are extensions of said sidewalls.

20. The block of claim 18 wherein said tongues and grooves are offset from a longitudinal centerline of the block.

21. The block of claim 18 or 19 wherein one tongue and the first flange of one of said projections intersect in a longitudinally and vertically oriented plane and are integral with each other adjacent the intersection of an end face and an upper surface.

22. An interlocking building block comprising:

a pair of spaced sidewalls, and first and second end walls spaced from each other and joined to said sidewalls, said block having upper and lower surfaces, each of said upper and lower surfaces having a first half lying on one side of a lateral centerline of the block and a second half lying on the other side of the lateral centerline, said first half carrying an "h" shaped, vertically extending projection having a web joining a first flange to a shorter second flange, said web being positioned laterally across said surface and being positioned adjacent to said first end wall, said flanges being positioned longitudinally relative to said block, said first half carrying an "H" shaped, vertically oriented recess having a web portion adjoining a first flange portion to a second flange portion, said web portion being positioned laterally across said surface and spaced away from said web, said flange portions being positioned longitudinally relative to said block, said first end wall having at least one longitudinally projecting tongue and one longitudinally extending groove, said tongue being vertically oriented and said groove being vertically oriented, said tongue and groove being positioned on said first end face so that the tongue and groove on said end face is complementary to and engageable with a respective groove and tongue on an abutting first end face of an identical block that is longitudinally aligned with said building block, said projection and recess on said first half of said block being shaped and positioned so that they are complementary to and engageable with a respective projection and recess on an abutting surface of an identical block that is longitudinally offset by one-half the length by said building block, the second half of each of said upper and lower surfaces further comprising an "L" shaped, vertically extending projection and a complementary "L" shaped recess, one of the flanges of said "L" shaped member being positioned adjacent said second end face, said "L" shaped flange and "L" shaped recess being positioned and shaped so that they are complementary to and engageable with a respective "L"-shaped projection and "L"-shaped recess on an abutting second half of a surface of an identical block that is rotated 90° about a vertical axis and 180° about a longitudinal, horizontal axis with respect to said building block, said block further carrying a pair of spaced, vertically extending grooves adjacent to said second half of said surfaces, said grooves being spaced to receive a longitudinally extending tongue of an abutting first end face of an identical block.

23. An interlocking building block comprising:

a pair of spaced sidewalls, first and second end walls joining said sidewalls and being spaced from each other, each of said end walls having respective first and second end faces, said end faces each having at least one longitudinally projecting tongue and one longitudinally recessed groove, said tongue and groove being positioned at identical locations on said first and second end faces and further being positioned so that the tongue and groove on each of said faces is complementary to and engages with a respective groove and tongue on an abutting face of an identical block that is longitudinally aligned with said building block, said block having identical upper and lower surfaces, each of said surfaces carrying a pair of vertically extending projections and adjoining vertically recessed recesses, one of said vertically extending projections and adjoining recesses on each of said upper and lower surfaces forming a first set, the other of said vertically extending projections and adjoining vertically extending recesses on each of said upper and lower surfaces forming a second set, the first set of projections and recesses being shaped and positioned so that the projections and recesses of said first set is complementary to and engages with a respective pair of projections and recesses on an abutting surface of an identical block that is longitudinally offset by a distance greater than one-half the length of said block, the second set of projections and recesses being different from said first set, said second set of projections and recesses being shaped and positioned so that the projections and recesses of said second set is complementary to and engages with a respective pair of projections and recesses on an opposing and abutting surface of an identical block that is longitudinally offset by less than one-half the length of said block.

24. An interlocking building block comprising:

a pair of spaced sidewalls, and first and second end walls spaced from each other and joined to said sidewalls, said block having upper and lower surfaces carrying an "h" shaped, vertically extending projection having a web joining a first flange to a shorter second flange, said web being positioned laterally across said surfaces and being positioned adjacent to said first end wall and said flanges being oriented orthogonally relative to said first end wall, said upper and lower surfaces carrying an "H" shaped vertical recess having a web portion joining a first flange portion to a second flange portion, said web portion being spaced away from said web and positioned laterally across said surfaces adjacent to said second end wall, said flange portions being oriented orthogonally relative to said second end wall, said first end wall having at least one orthogonally projecting tongue and one orthogonally extending groove, said tongue being vertically oriented and said groove being vertically oriented, said tongue and groove being positioned on said first end face so that the tongue and groove on said end face is complementary to and engageable with a respective groove and tongue on an abutting first end face of an identical block that is longitudinally aligned with said building block, said projections and recesses on the upper and lower surfaces of said block being shaped and positioned so that they are complementary to and engageable with a respective projection and recess on an abutting surface of an identical block, said second end face being substantially flat.

25. An interlocking pilaster building block comprising:

a first pair of spaced sidewalls, and a first pair of first and second end walls joining said sidewalls and being spaced from each other, each of said end walls having respective first and second end faces, said block having first upper and lower surfaces each carrying a pair of vertically extending projections and adjoining vertically recessed recesses, said projections and recesses being shaped and positioned so that one of said pair of projections and recesses is complementary to and engages respective projections and recesses on an abutting surface of an identical block that is longitudinally offset by one-half the length of said block, each of said end faces including at least one longitudinally projecting tongue and one longitudinally recessed groove, said tongues and grooves being positioned at substantially identical locations on said first and said second end faces and further being positioned so that the tongue and groove on each of said end faces is complementary to and engages a respective groove and tongue on an abutting end face of an identical block that is longitudinally aligned with said building block, a second pair of spaced sidewalls, and a second pair of first and second end walls joining said second pair of sidewalls and being spaced from each other, one of said sidewalls of said second pair of spaced sidewalls being joined to and integral with one of said sidewalls of said first pair of spaced sidewalls, said second block having second upper and lower surfaces, each of said second upper and lower surfaces carrying recesses that are complementary to and engageable with the projections on an abutting surface that is identical to said first upper and lower surfaces.

26. A bond beam building block comprising:

a pair of spaced sidewalls, and first and second end walls adjoining said sidewalls and being spaced from each other, said end walls extending substantially half the height of said sidewalls, said end walls and the edges of said sidewalls forming first and second end faces, each of said end faces including at least one longitudinally projecting tongue and one longitudinally recessed groove, said tongues and grooves being positioned at substantially identical locations on said first and second end faces, and further being positioned so that the tongue and groove on each of said end faces is complementary to and engages a respective groove and tongue on an abutting end face of an identical block that is longitudinally aligned with said building block, said first end face being substantially identical to said second end face, said block having upper and lower surfaces, said upper and lower surfaces carrying a plurality of vertically extending projections and adjoining vertically recessed recesses, said projections and recesses being shaped and positioned to be complementary to and engageable with respective projections and recesses on an abutting surface of an identical block that is longitudinally offset by one-half the length of said block.

* * * * *